US009016796B2

(12) United States Patent
Portis

(10) Patent No.: US 9,016,796 B2
(45) Date of Patent: Apr. 28, 2015

(54) PORTABLE PEDESTAL STOOL

(71) Applicant: Erwin Portis, Kellyton, AL (US)

(72) Inventor: Erwin Portis, Kellyton, AL (US)

( * ) Notice: Subject to any disclaimer, the term of this patent is extended or adjusted under 35 U.S.C. 154(b) by 0 days.

(21) Appl. No.: 13/875,559

(22) Filed: May 2, 2013

(65) Prior Publication Data

US 2014/0327289 A1 Nov. 6, 2014

(51) Int. Cl.

| | |
|---|---|
| ***A47C 9/00*** | (2006.01) |
| ***A47C 25/00*** | (2006.01) |
| ***A47C 3/34*** | (2006.01) |
| ***A47C 4/28*** | (2006.01) |
| ***A47C 9/10*** | (2006.01) |

(52) U.S. Cl.
CPC ... *A47C 3/34* (2013.01); *A47C 4/28* (2013.01); *A47C 9/10* (2013.01)

(58) Field of Classification Search
CPC ..... A47C 4/283; A47C 9/10; A47C 4/48; A47C 4/40; A47C 4/44
USPC ..... 297/461, 452.56, 452.13, 452.1, 16.1, 297/16.2, 44, 45, 46, 54; 108/129, 115, 108/159.12, 137, 147.19; 248/173
See application file for complete search history.

(56) References Cited

U.S. PATENT DOCUMENTS

| | | | | |
|---|---|---|---|---|
| 1,240,119 | A * | 9/1917 | Burns | 108/141 |
| 1,565,636 | A * | 12/1925 | Goetz | 297/461 |
| 2,010,306 | A * | 8/1935 | Leech | 248/412 |
| 2,359,821 | A * | 10/1944 | Black | 108/115 |
| 2,498,837 | A * | 2/1950 | Gelman | 5/247 |
| 2,544,615 | A * | 3/1951 | Raymond | 108/146 |
| 2,730,419 | A * | 1/1956 | Roberton et al. | 108/156 |
| 2,759,528 | A * | 8/1956 | Rachman et al. | 108/5 |
| 3,266,839 | A * | 8/1966 | Combs | 297/57 |
| 6,467,843 | B1 * | 10/2002 | Rossborough | 297/344.18 |
| 6,899,388 | B1 * | 5/2005 | Enrique | 297/184.16 |
| 8,292,370 | B1 * | 10/2012 | Hygh | 297/461 |
| 8,322,785 | B2 * | 12/2012 | Grace et al. | 297/56 |
| 2003/0164633 | A1 * | 9/2003 | Jakus et al. | 297/271.5 |
| 2012/0080909 | A1 * | 4/2012 | Grace et al. | 297/16.1 |
| 2013/0187431 | A1 * | 7/2013 | Grace | 297/452.48 |
| 2014/0054942 | A1 * | 2/2014 | Emrich | 297/334 |

* cited by examiner

*Primary Examiner* — Chi Q Nguyen
(74) *Attorney, Agent, or Firm* — Law Office of Jerry D. Haynes P.A.

(57) ABSTRACT

A portable stool for providing convenient seating comprising: a base, where the base is placed on a surface during use of the stool; a support post, where the support post extends vertically from the base; a telescoping post connected to the support post, where the telescoping post is vertically adjustable; openings along the telescoping post; seat posts, where the seat posts extend vertically from the openings; and a nylon seat attached to each distal end of the seat posts. The telescoping post may include three openings and a seat post extends from each opening. In one particular embodiment, the posts extend at an angle from each opening. The support post may include an adjustment slot. Inherently the portable stool further includes a collapsed position and an extended position.

5 Claims, 1 Drawing Sheet

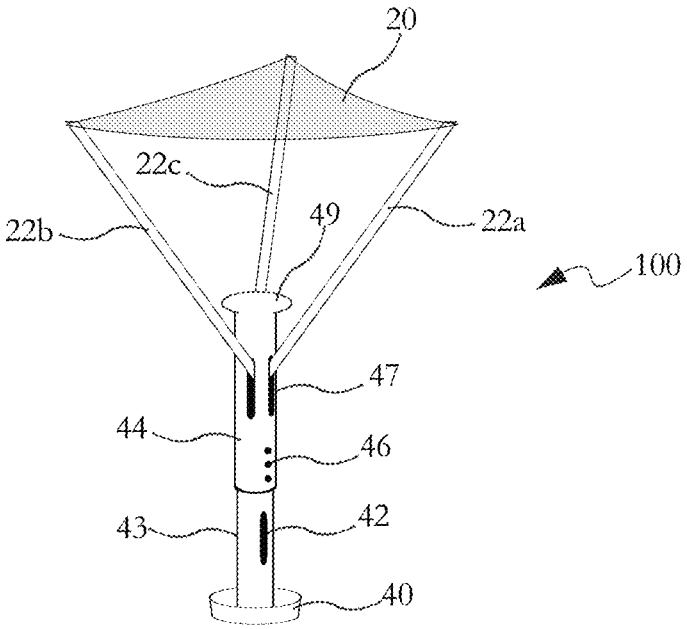
20
22c
22b
49
22a
100
47
44
46
43
42
40

PORTABLE PEDESTAL STOOL

BACKGROUND OF THE INVENTION

1. Field of Invention

The present invention relates to a portable stool that includes feature of a pedestal with a flexible nylon seat.

2. Description of Related Art

Portable stools are well known in the prior art. Portable stools are normally, in a tripod design that includes a nylon seat attached to the tripod, creating a means for a user to conveniently place a seat in any position. One example of a tripod seat is disclosed in U.S. Pat. No. 4,934,638, which discusses a collapsible tripod stool and has a triangular seat with tubular legs. Similar tripod designs are available as disclosed in U.S. Pat. No. 6,135,557, which discusses a foldable stool with a triangular-type seat with three upper legs. The seat of the '557 patent collapses for portability similar to the '638 patent. An alternative to the tripod style is a collapsible seat that is mounted on a pedestal type position. Such an example of a pedestal type stool is disclosed in U.S. Pat. No. 6,467,843, which discusses a collapsible seat with a seating member and a base member that are substantially identical with the seat member and base member are removably engaged by a telescopic pedestal. Although various designs are available further improvement in this area is needed for convenient portable seats for various applications.

SUMMARY OF THE INVENTION

The present invention relates to a portable stool for providing convenient seating comprising: a base, where the base is placed on a surface during use of the stool; a support post, where the support post extends vertically from the base; a telescoping post connected to the support post, where the telescoping post is vertically adjustable; openings along the telescoping post; seat posts, where the seat posts extend vertically from the openings; and a nylon seat attached to each distal end of the seat posts. The telescoping post may include three openings and a seat post extends from each opening. In one particular embodiment, the posts extend at an angle from each opening. The support post may include an adjustment slot. Inherently the portable stool further includes a collapsed position and an extended position.

BRIEF DESCRIPTION OF DRAWINGS

FIG. 1 depicts a portable pedestal stool in accordance with the present invention.

DETAILED DESCRIPTION

The present invention relates to a pedestal stool that includes a tubular support post that stands vertical from a base. The base may be placed on a flat surface for supporting the seat. Extending from the post are seat posts that extend vertically at an angle and provide support for a nylon flexible seat connected to each extended end of the seat post. The seat post may be easily retracted into openings provided in the support post and therefore create a portable seat contained within the support post of the seat.

In reference to FIG. 1, a pedestal stool 100 is depicted. The pedestal stool includes a base 40 that provides the primary support means on a surface such as a ground or floor for placement of the stool 100. Extending vertically from the base 40 is a support post 43. The support post 43 extends vertically and connects with a telescoping post 44. The telescoping post 44 may be adjusted vertically through the use of an adjustment slot 42 and in conjunction with tabs 46. The tabs 46 connect and support the connection between the support post 43 and telescoping post 44.

The telescoping post 44 includes openings 47 as shown. Extending at an angle from the openings 47 are seat posts 22*a*, 22*b*, and 22*c*. The seat posts 22*a*, 22*b*, and 22*c* extend from the telescoping post 44 to provide a means to connect a nylon seat 20 to the distal end of each respective seat posts. The openings 47 for the seat posts 22*a*, 22*b*, and 22*c* are just below a top cap 49 at a distal end of the telescoping post 44. Conveniently in a collapsed position the seat posts 22*a*, 22*b*, 22*c* detract into the openings 47 and allow for the collapse of the stool 100. The stool 100 as shown in FIG. 1 is in an extended position capable of supporting the weight of an individual seated in the seat 20.

The pedestal stool in accordance with the present invention provides a unique means to collapse and extend the seat support posts creating a pedestal-type configuration connected to a single pedestal post. This feature of the pedestal stool allows the stool to have a more compact collapsed position and protect the seat post from damage during travel.

What is claimed is:

1. A portable stool for providing convenient seating comprising:

a. a base, where the base is placed on a surface during use of the stool;

b. a support post, where the support post extends vertically from the base;

c. a telescoping post connected to the support post, where the telescoping post is vertically adjustable;

d. an adjustment slot on the support posts;

e. a plurality of tabs on the telescoping post to support and connect the support post to the telescoping post, where the plurality of tabs vertically adjusts the telescoping post in conjunction with the adjustment slot;

f. openings along the telescoping post;

g. seat posts, where the seat posts extend vertically from the openings; and h. a nylon seat attached to each distal end of the seat posts.

2. The portable stool according to claim 1, where the telescoping post includes three opening and a seat post extends from each opening.

3. The portable stool according to claim 1, where the posts extend at an angle from each opening.

4. The portable stool according to claim 1, where stool further includes a collapsed position and an extended position.

5. The portable stool according to claim 4, where the seat posts detract into the openings to create the collapsed position.

* * * * *